US006477920B1

(12) United States Patent
Yang

(10) Patent No.: US 6,477,920 B1
(45) Date of Patent: Nov. 12, 2002

(54) CORK REMOVAL APPARATUS

(76) Inventor: Heng-Te Yang, P.O. Box 90, Tainan City (TW)

( * ) Notice: Subject to any disclaimer, the term of this patent is extended or adjusted under 35 U.S.C. 154(b) by 0 days.

(21) Appl. No.: 10/015,761

(22) Filed: Dec. 17, 2001

(51) Int. Cl.[7] ..... B67B 7/08

(52) U.S. Cl. ..... 81/3.2; 81/3.25; 141/19; 222/5

(58) Field of Search ..... 81/3.2, 3.48, 3.29; 222/5; 141/19

(56) References Cited

U.S. PATENT DOCUMENTS 5,005,446 A * 4/1991 Mackey ..... 141/19
5,012,703 A * 5/1991 Reinbacher ..... 81/3.2
5,020,395 A * 6/1991 Mackey ..... 141/19

* cited by examiner

*Primary Examiner*—D. S. Meislin

(57) ABSTRACT

A cork removal apparatus in the invention has an exterior barrel, a interior barrel mounted inside the exterior barrel, a telescoping barrel engaged between the exterior barrel and the interior barrel, a needle, a partition plate attached inside the telescoping barrel and extended through by the needle, and a cover with a press-in member. The needle fixed at a bottom of the interior barrel has a gas inlet, a gas passageway and a gas outlet. Place a gas container into the interior barrel with its release nozzle downwardly aligned to the gas inlet, combine the cover on the exterior barrel and penetrate the needle through a cork so that a depressing of the press-in member can force gas of the gas container to flow through the needle into the bottle to extract the cork upwardly from the bottle to achieve a rapid, convenient, laborsaving and safe removal of a cork.

6 Claims, 8 Drawing Sheets

CORK REMOVAL APPARATUS

BACKGROUND OF THE INVENTION

1. Field of the Invention

This invention relates to a cork removal apparatus, particularly to one capable of rapidly removing a cork from a bottle body, which is safe and laborsaving to use.

2. Description of the Prior Art

Generally speaking, a known conventional corkscrew 1 often used to remove corks from bottles, such as wine bottles, has a handle 10 disposed at an upper portion and a worm 11 disposed at a lower portion, as shown in FIG. 1. In operation, place a point of the worm 11 on a cork sealed a mouth of a bottle, and then turn the handle 10 to insert the worm 11 downwardly into the cork. When the worm 11 is inserted into the cork to a required depth, pull the cork with an outward force to extract the cork from the mouth of the bottle. However, because the cork was compressed and tightly fitted into the mouth of the bottle to prevent the wine from becoming insipid or sour, the removing of the cork requires a very strong pull. If the worm 11 is not inserted into the cork with an enough depth, the cork is unable to be extracted from the mouth of the bottle and is liable to be broken therein. If the worm 11 is inserted into the cork too deep, the cork is liable to be shred to leave its particles in the wine, which will have bad influence in the quality of the wine.

SUMMARY OF THE INVENTION

The main purpose of the invention is to offer a cork removal apparatus capable of rapidly removing a cork from a bottle body, which is safe and laborsaving to use.

The main feature of the invention is to provide a cork removal apparatus mainly including:

a exterior barrel;

a interior barrel capable of being mounted inside the exterior barrel for accommodating a gas container and having a stop part located at a proper position of an outer surface of a lower portion and a needle holder disposed at a bottom thereof;

a telescoping barrel capable of being engaged between the exterior barrel and the interior barrel and having an upper portion designed as a telescoping neck as well as a lower portion designed as a chamber, a stop edge located at a proper position of an inner surface of the upper portion of the telescoping barrel, a holding edge disposed at a inner surface of the chamber;

a needle capable of being fixed to the needle holder of the interior barrel and longitudinally extending into the chamber disposed at the lower portion of the telescoping barrel, the needle having a gas inlet formed at a upper portion, a gas passageway disposed in a center and a gas outlet disposed proximate a lower end thereof;

a partition plate capable of being firmly attached to the holding edge disposed at the inner surface of the lower portion of the telescoping barrel and having a through hole formed at a center of the partition plate for being extended through by the needle; and, a cover capable of being combined on an upper end of the exterior barrel and provided with a press-in member.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
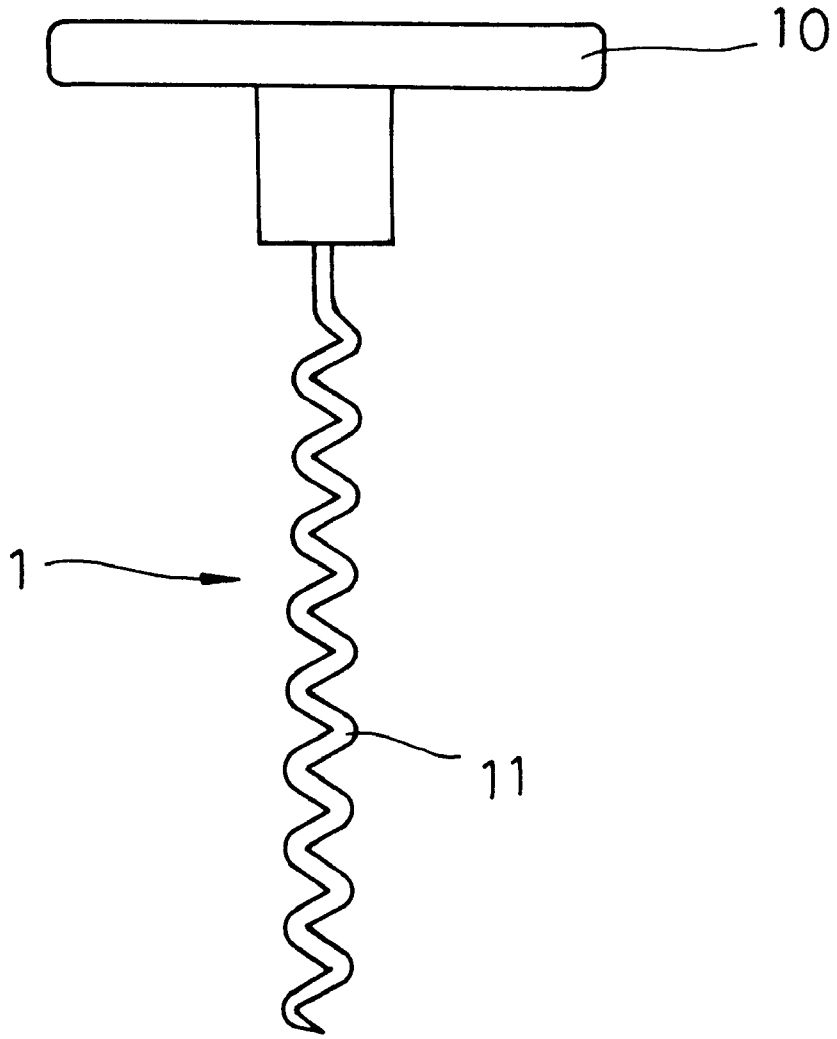
FIG.1 (PRIOR ART)
FIG. 1 is a schematic view showing the construction of a known conventional of a corkscrew.
Figure 2:
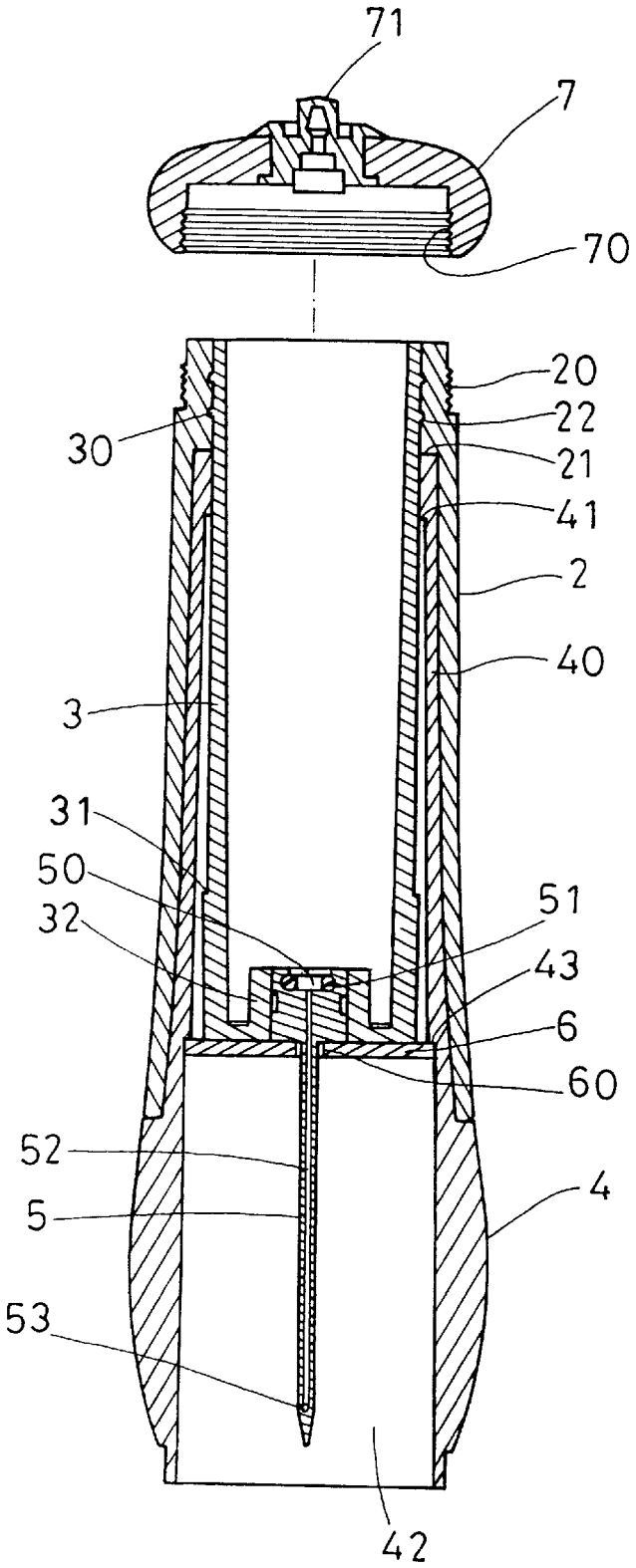
FIG. 2 is a cross-sectional view showing the construction of a cork removal apparatus in the present invention.
Figure 3:
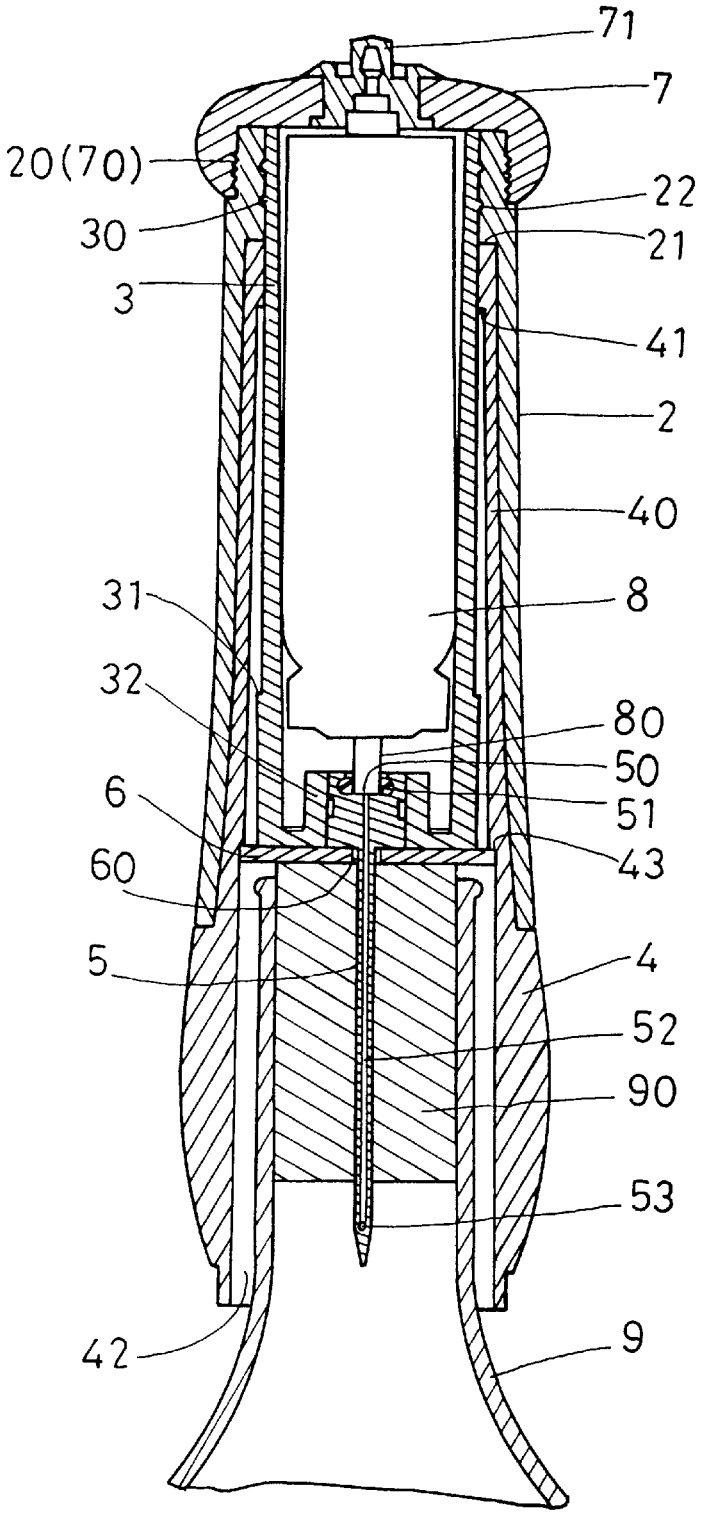
FIG. 3 is a cross-sectional view showing an assemblage of the cork removal apparatus in the present invention.

A preferred embodiment of a cork removal apparatus in the present invention, as shown in FIGS. 2 and 3, mainly includes an exterior barrel 2, an interior barrel 3, a telescoping barrel 4, a needle 5, a partition plate 6 and a cover 7.

The exterior barrel 2 has external threads 20 disposed at an upper portion, a stop wall 21 in an inverted "L" shape disposed at an inner surface proximate the upper portion and a plurality of ring grooves 22 formed in the inner surface above the stop wall 21.

The interior barrel 3 is capable of being mounted inside the exterior barrel 2 for accommodating a gas container 8. The interior barrel 3 has a plurality of flanged rings 30 disposed at an outer surface of an upper portion for corresponding to the plurality of ring grooves 22 of the exterior barrel 2, a stop part 31 located at a proper position of an outer surface proximate a lower portion and a needle holder 32 disposed at a bottom thereof.

The telescoping barrel 4 capable of being engaged between the exterior barrel 2 and the interior barrel 3 has an upper portion designed as a telescoping neck 40 and a lower portion designed as a chamber 42. A top end of the telescoping barrel 4 is just stopped against the stop wall 21 of the exterior barrel 2. A stop edge 41 is located at a proper position of an inner surface of an upper portion of the telescoping barrel 4. A holding edge 43 is disposed at an inner surface of the chamber 42.

The needle 5 is capable of being fixed to the needle holder 32 disposed at a the bottom of the interior barrel 3 and longitudinally extending into the chamber 42 disposed at the lower portion of the telescoping barrel 4. The needle 5 has a gas inlet 50 formed at an upper portion, a gas passageway 52 disposed in a center as well as a gas outlet 53 disposed proximate a lower end and laterally extending through the lower end. A stop ring 51 is set in the gas inlet 50.

A partition plate 6 capable of being firmly attached to the holding edge 43 disposed at the inner surface of the chamber 42 of the telescoping barrel 4 has a through hole 60 formed at a center thereof for being extended through by the needle 5.

The cover 7 capable of being screwed on an upper end of the exterior barrel 2 has internal threads 70 disposed at an inner surface for corresponding to the external threads 20 of the exterior barrel 2 and a press-in member 71 disposed at a center thereof.

Figure 4:
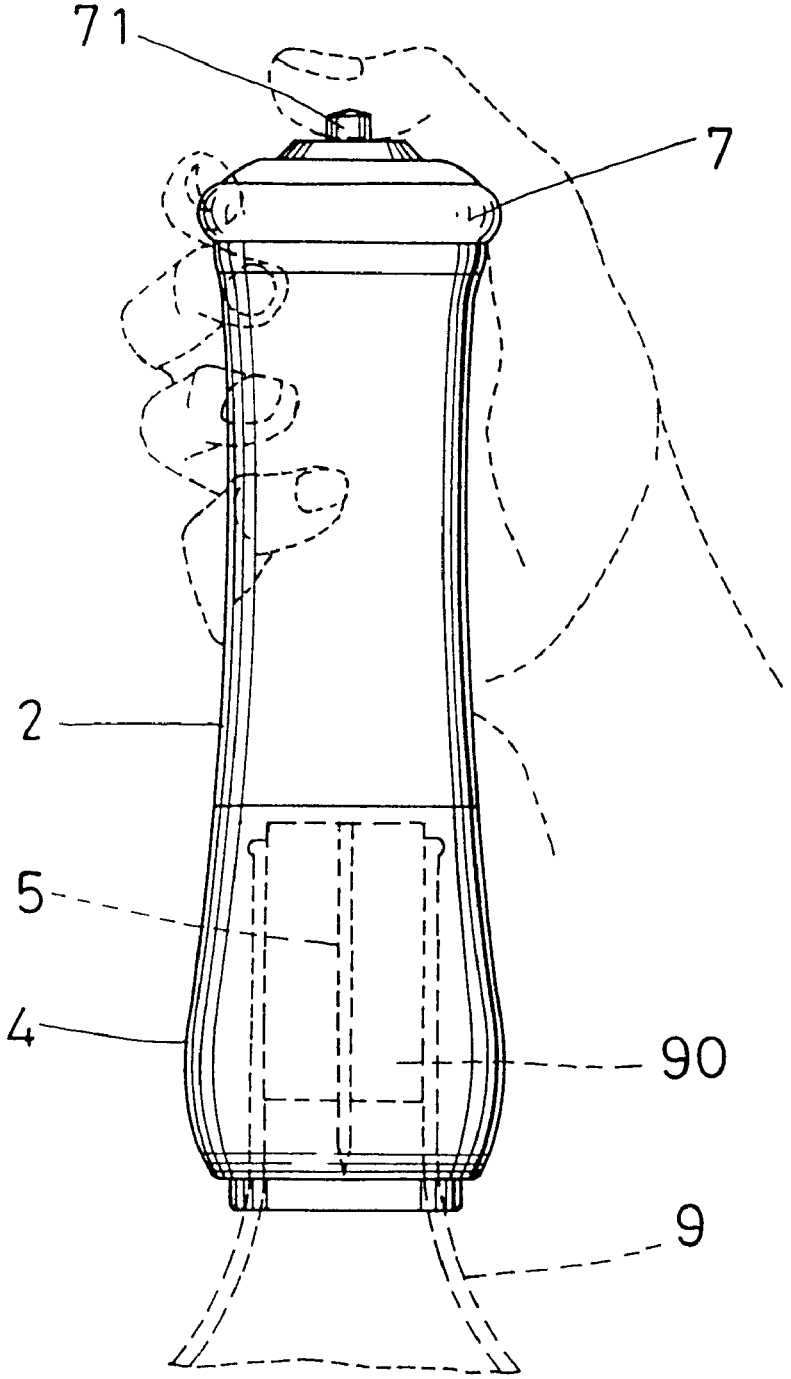
FIG. 4 is a schematic view showing an operation of the cork removal apparatus in the present invention.

In assembling, referring to FIGS. 2 to 4, firstly mount the interior barrel 3 inside the exterior barrel 2 to make the plurality of flanged rings 30 of the interior barrel 3 correspondingly engaged with the plurality of ring grooves 22 of the exterior barrel 2 and to make the needle 5 fixed to the needle holder 32 of the interior barrel 3. Secondly, insert the telescoping neck 40 of the telescoping barrel 4 between the exterior barrel 2 and the interior barrel 3 to make the top end of the telescoping barrel 4 stopped against the stop wall 21 of the exterior barrel 2 and to make the stop edge 41 that is disposed at the inner surface of the upper portion of the telescoping barrel 4 corresponding to the stop part 31 that is disposed at the outer surface of the lower portion of the interior barrel 3. Thirdly, after the through hole 60 of the partition plate 6 is extended through by the needle 5, and then the partition plate 6 is firmly attached to the holding edge 43 that is disposed at the inner surface of the chamber 42 of the telescoping barrel 4. Finally, screw the cover 7 on the upper end of the exterior barrel 2, by which the cork removal apparatus of the present invention is assembled all together.

Figure 5:
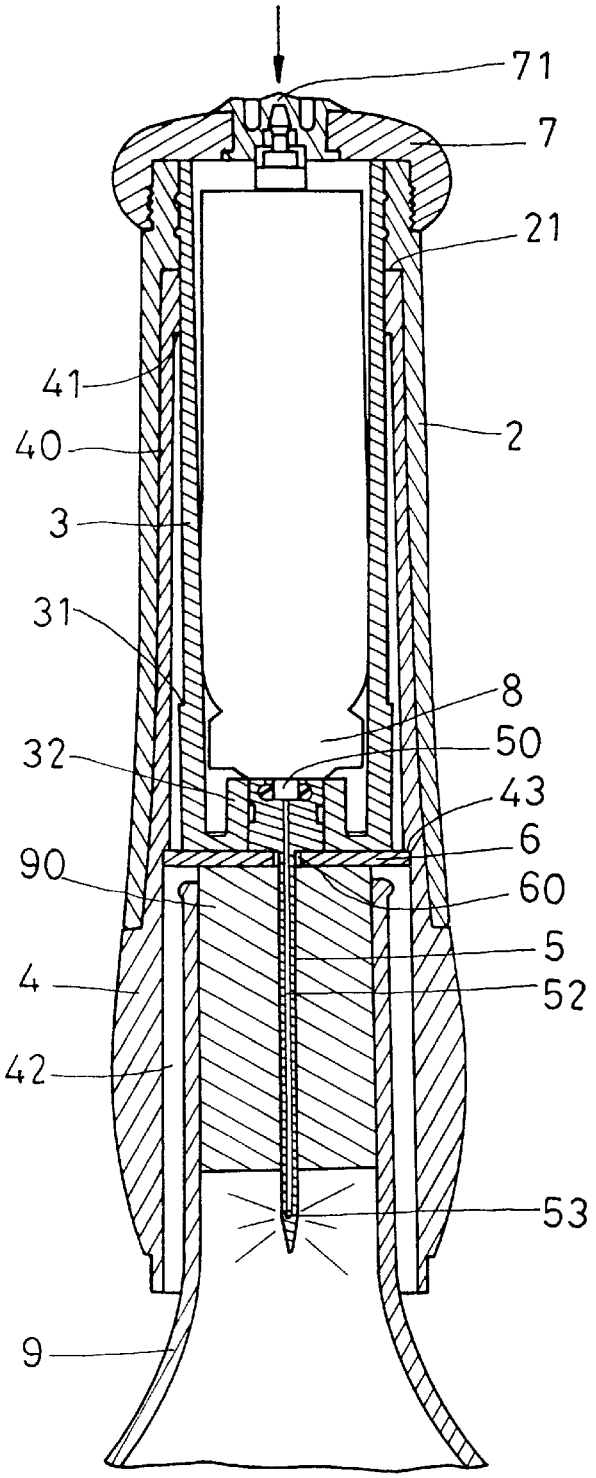
FIG. 5 is a schematic view showing a depressing of a press-in member of the cork removal apparatus in the present invention to propel a gas container to force gas to flow into a bottle.
Figure 6:
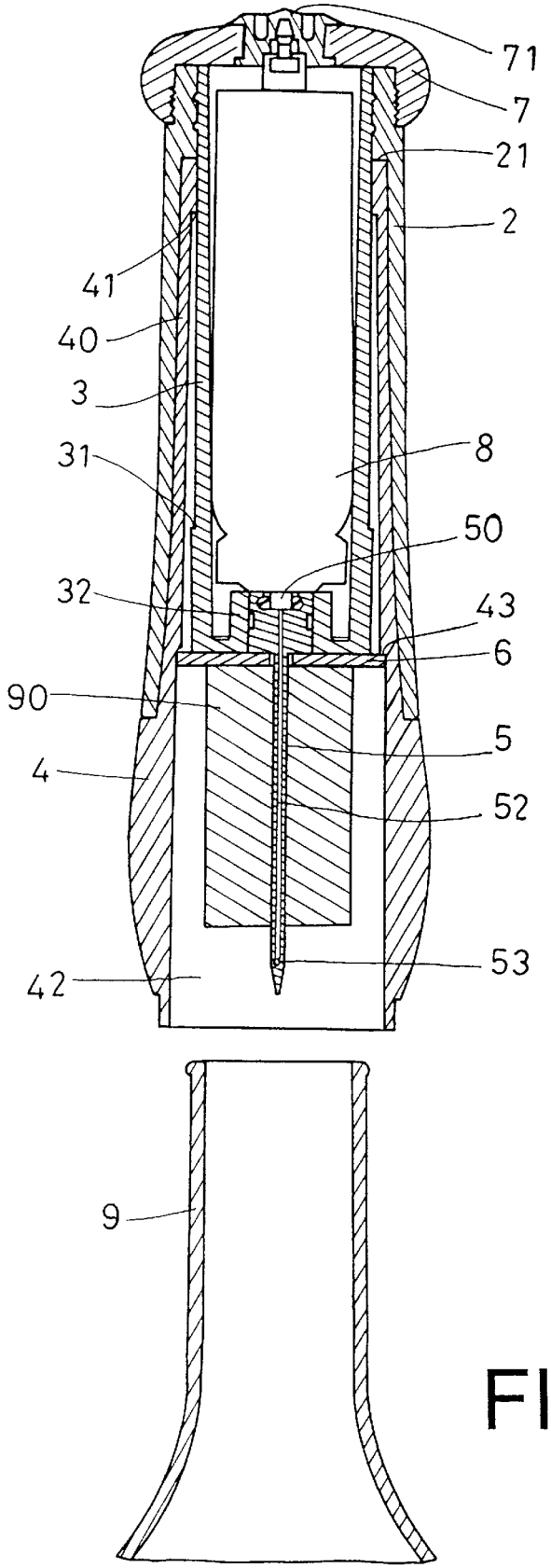
FIG. 6 is a schematic view showing an extraction of a cork from a mouth of the bottle under the working of the cork removal apparatus in the present invention.
Figure 7:
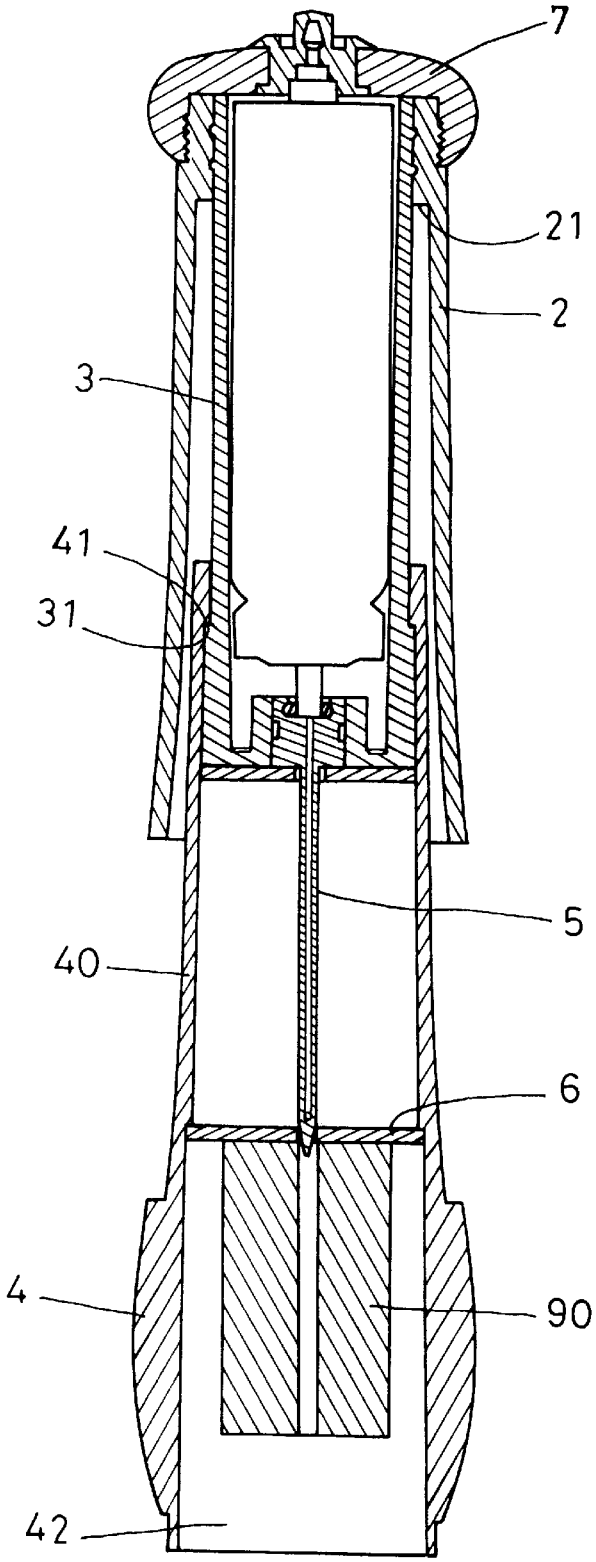
FIG. 7 is a schematic view showing an exterior barrel of the cork removal apparatus in the present invention being pulled upwardly along a telescoping barrel to withdraw a needle from the cork; and, FIG. 8 is a schematic view showing the exterior barrel of the cork removal apparatus in the present invention being drawn downwardly along the telescoping barrel for the convenience of taking off the cork.
Figure 8:
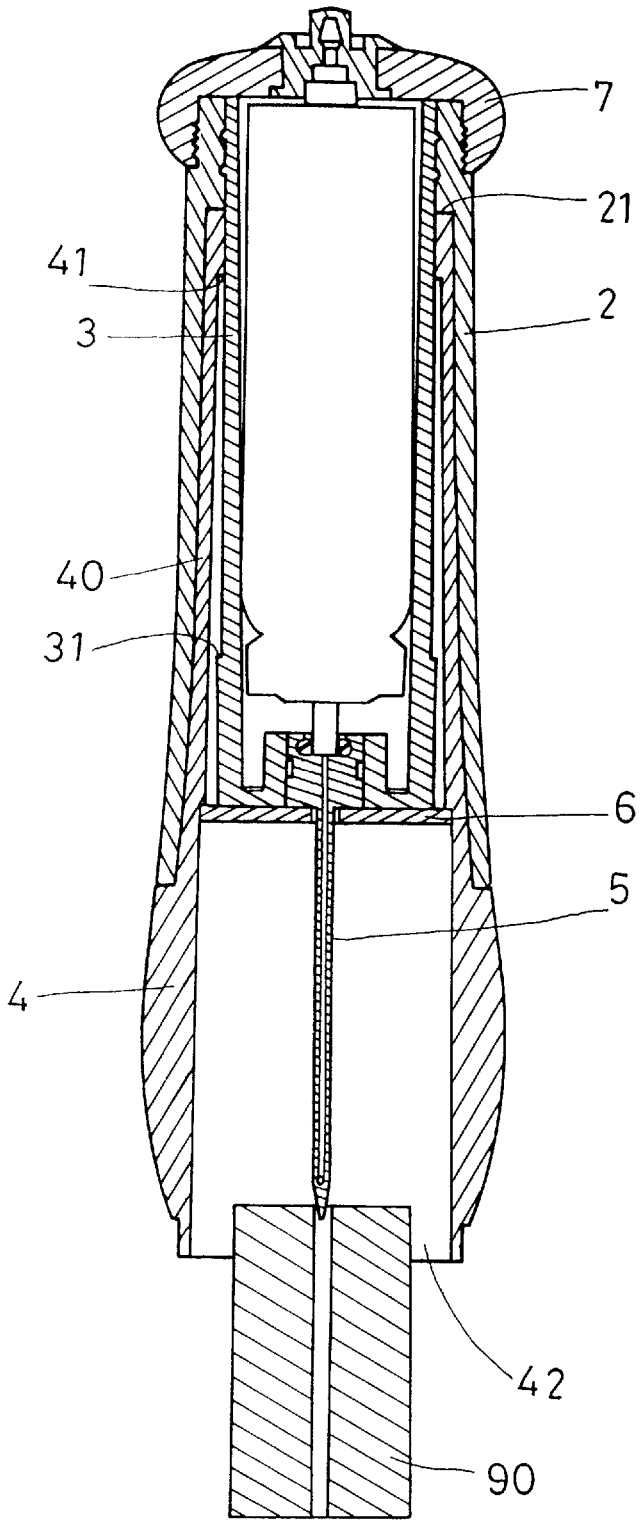

In using, referring to FIGS. 3 to 8, place the gas container 8 into the interior barrel 3 to make its release nozzle 80 downwardly aligned to the gas inlet 50 of the needle 5, and then screw the cover 7 on the upper end of the exterior barrel 2, as shown in FIG. 3. When a cork 90 is to be extracted from a mouth of a bottle body 9, place the bottle body 9 under the telescoping barrel 4 and exert a downward pressure to make the needle 5 penetrate through the cork 90. And then, depress the press-in member 71 of the cover 7 in a manner as shown in FIGS. 4 and 5, to propel the gas container 8 downwardly to force the gas of the gas container 8 to flow from the release nozzle 80 of the gas container 8, through the gas inlet 50, the gas passageway 52 and the gas outlet 53 of the needle 5, and outwardly into the interior of the bottle body 9, by which the cork 90 can be forcedly pushed upwardly and extracted from the mouth of the bottle body 9, as shown in FIG. 6. When the cork 90 is to be removed from the cork removal apparatus of the present invention, pull the exterior barrel 2 upwardly along the telescoping barrel 4 to move the needle 5 fixed to the bottom of the interior barrel 3 in such a upward manner as shown in FIG. 7 until the stop edge 41 of the telescoping barrel 4 is stopped by the stop part 31 of the interior barrel 3, by which the cork 90 is stopped by the partition plate 6 and stayed in the chamber 42 of the telescoping barrel 4 so that the needle 5 can be gradually withdrawn from the cork 90 by having the lower end of the needle 5 still kept a little insertion in an upper end of the cork 90. And then, draw back the exterior barrel 2 downwardly along the telescoping barrel 4 to make the cork 90 pushed out of the telescoping barrel 4 for the convenience of being taken off, as shown in FIG. 8.

The invention has the following advantages and effects, as can be understood from the aforesaid description.

1. The cork removal apparatus of the invention is capable of removing a cork from a bottle body, which is rapid and laborsaving to use.

2. The needle of the invention is permanently fixed inside the barrels of the cork removal apparatus without the danger of being exposed outside the barrels, which is very save to use.

While the preferred embodiment of the invention has been described above, it will be recognized and understood that various modifications may be made therein and the appended claims are intended to cover all such modifications that may fall within the spirit and scope of the invention.

What is claimed is:

1. A cork removal apparatus comprising:

a exterior barrel;

a interior barrel capable of being mounted inside said exterior barrel for accommodating a gas container and having a stop part located at a proper position of an outer surface of a lower portion and a needle holder disposed at a bottom thereof;

a telescoping barrel capable of being engaged between said exterior barrel and said interior barrel and having an upper portion designed as a telescoping neck as well as a lower portion designed as a chamber, a stop edge located at a proper position of an inner surface of said upper portion of said telescoping barrel, a holding edge disposed at an inner surface of said chamber;

a needle capable of being fixed to said needle holder of said interior barrel and longitudinally extending into said chamber disposed at said lower portion of said telescoping barrel, said needle having a gas inlet formed at an upper portion, a gas passageway disposed in a center and a gas outlet disposed proximate a lower end thereof;

a partition plate capable of being firmly attached to said holding edge disposed at said inner surface of said lower portion of said telescoping barrel and having a through hole formed at a center of said partition plate for being extended through by said needle;

a cover capable of being combined on an upper end of said exterior barrel and provided with a press-in member; and, whereby a combination of said components described above in using is capable of having said gas container placed into said interior barrel to make a release nozzle of said gas container downwardly aligned to said gas inlet of said needle, having said cover combined on said upper portion of said exterior barrel, and having said telescoping barrel covered on a mouth of a bottle to make said needle downwardly penetrate through a cork sealed in said mouth of said bottle so that a depressing of said press-in member of said cover can propel said gas container downwardly to force gas of said gas container to flow from said gas container, through said gas inlet of said needle and outwardly into the interior of said bottle to extract said cork upwardly from said mouth of said bottle to achieve a rapid, convenient, laborsaving and safe removal of a cork.

2. The cork removal apparatus as claimed in claim 1, wherein a plurality of ring grooves are disposed in an inner surface of an upper portion of said exterior barrel; a plurality of flanged rings are disposed in an outer surface of an upper portion of said interior barrel for being correspondingly engaged with said plurality of ring grooves of said exterior barrel.

3. The cork removal apparatus as claimed in claim 1, wherein a stop wall in an inverted "L" shape is disposed at an inner surface proximate an upper portion of said exterior barrel for being stopped against by a top end of said telescoping barrel.

4. The cork removal apparatus as claimed in claim 1, wherein external threads are disposed at an upper portion of said exterior barrel; internal threads are disposed at an inner surface of said cover for the convenience of being correspondingly screwed with said external threads of said exterior barrel.

5. The cork removal apparatus as claimed in claim 1, wherein said gas inlet is formed at an upper portion of said needle for being correspondingly inserted by said release nozzle of said gas container; a stop ring is set in said gas inlet of said needle for closing said release nozzle of said gas container to avoid gas leakage.

6. The cork removal apparatus as claimed in claim 1, wherein when said cork is to be taken off after being extracted from said bottle, pull said exterior barrel upwardly along said telescoping barrel to move said needle fixed to said bottom of said interior barrel in such a upward manner until said stop edge of said telescoping barrel is stopped by said stop part of said interior barrel, by which said cork is stopped by said partition plate and stayed in said chamber of said telescoping barrel so that said needle can be gradually withdrawn from said cork by having said lower end of said needle still kept a little insertion in an upper end of said cork, and then draw back said exterior downward along said telescoping barrel to make said cork pushed out of said telescoping barrel for the convenience of being taken off.

* * * * *